US006486621B1

(12) United States Patent
Novarese et al.

(10) Patent No.: US 6,486,621 B1
(45) Date of Patent: Nov. 26, 2002

(54) ELECTRONIC SYSTEM FOR GENERATING AND CONTROLLING LIGHT EFFECTS ON PROJECTORS

(75) Inventors: Fabio Novarese, Valenza (IT); Bruno Baiardi, Felizzano (IT)

(73) Assignee: Space Cannon VH S.r.l. (IT)

( * ) Notice: Subject to any disclaimer, the term of this patent is extended or adjusted under 35 U.S.C. 154(b) by 0 days.

(21) Appl. No.: 09/806,751

(22) PCT Filed: Oct. 8, 1999

(86) PCT No.: PCT/EP99/07779

§ 371 (c)(1),
(2), (4) Date: Apr. 3, 2001

(87) PCT Pub. No.: WO00/22891

PCT Pub. Date: Apr. 20, 2000

(30) Foreign Application Priority Data

Oct. 14, 1998 (IT) ..... RE98A0101

(51) Int. Cl.[7] ..... G05F 1/00

(52) U.S. Cl. ..... 315/308; 315/209 R; 315/224; 315/225; 315/276

(58) Field of Search ..... 315/209 R, 224, 315/225, 226, 209 T, 244, 258, 276, 283, 291, 307, 360, 308, DIG. 7

(56) References Cited

U.S. PATENT DOCUMENTS

| | | | | |
|---|---|---|---|---|
| 4,422,016 A | | 12/1983 | Kurple | 315/241 S |
| 4,643,571 A | | 2/1987 | Ferber et al. | 356/326 |
| 5,105,127 A | | 4/1992 | Lavaud et al. | 315/291 |
| 5,192,897 A | | 3/1993 | Vossough et al. | 315/308 |
| 5,363,020 A | * | 11/1994 | Chen et al. | 315/209 R |
| 6,094,017 A | * | 7/2000 | Adamson | 315/209 R |

FOREIGN PATENT DOCUMENTS

| | | |
|---|---|---|
| DE | 41 28 551 | 3/1992 |
| GB | 2 211 636 | 7/1989 |
| WO | WO 83 00596 | 2/1983 |
| WO | WO 86 01066 | 2/1986 |
| WO | WO 87 04038 | 7/1987 |

* cited by examiner

*Primary Examiner*—Don Wong
*Assistant Examiner*—Thuy Vinh Tran
(74) *Attorney, Agent, or Firm*—Browdy and Neimark, P.L.L.C.

(57) ABSTRACT

Electronic system for generating and controlling light effects on projectors utilizing arc lamps, composed of an electronic power unit provided with a transformer fed via transistors, the secondary circuit of the transformer being connected to the feed terminals of the lamp, within the secondary circuit of the transformer there being connected a component for withdrawing a proportion of the instantaneous current circulating through the secondary circuit to produce an electrical signal which is made available to a control block which also receives an electrical reference signal generated by a pulse generator, the control block being arranged to compare the two electrical signals and to set the transistors to a conducting or inhibiting state depending on the result of the comparison, the amplitude and frequency of the electrical reference signal being adjustable by the operator.

8 Claims, 3 Drawing Sheets

ELECTRONIC SYSTEM FOR GENERATING AND CONTROLLING LIGHT EFFECTS ON PROJECTORS

REFERENCE TO RELATED APPLICATIONS

Figure 1A:
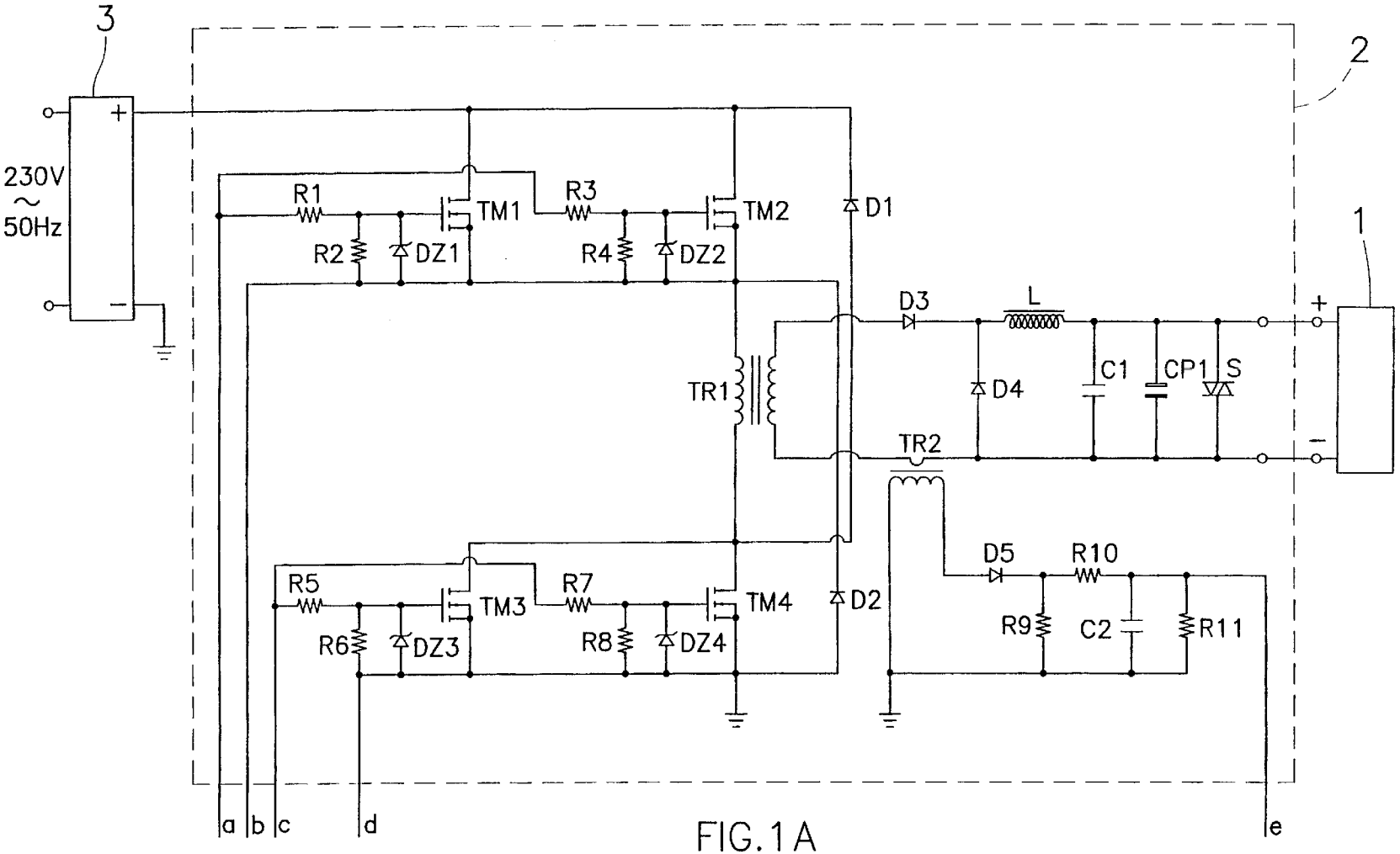

The present application is the national stage under 35 U.S.C. 371 of international application PCT/EP99/07779, filed Oct. 08, 1999 which designated the United States, and which international application was published under PCT Article 21 (2) in the English language.

TECHNICAL FIELD

This invention generally concerns an electronic system for controlling the power fed to light beam projectors, particularly of medium and high power, which use short arc lamps such as xenon and metal halide lamps. More specifically, the invention relates to an electronic control system which enables both a stroboscopic effect and a dimmer effect to be obtained with said type of lamp.

BACKGROUND ART

The known art teaches that with this type of lamp a stroboscopic effect, ie, a rapid variation in light intensity, and a dimmer effect, ie, an attenuation in light intensity, can only be obtained by using mechanical means.

To achieve a stroboscopic effect, devices are known comprising vanes which are made to oscillate in a plane perpendicular to the light beam so as to obscure the beam. The maximum vane oscillation frequency which can be achieved-with devices of this type is of the order of 9 Hz for small and medium dimension projectors. As the projector dimensions increase the maximum vane oscillation frequency decreases. The ideal frequency at which the human eye perceives a stroboscopic effect lies between 7 and 10 Hz, which values can hence be approached only by small dimension projectors. In contrast, to achieve a dimmer effect, movable mechanical shutters are used located in front of the light beam in such a manner as to be able to partially or completely intercept their light flow.

A drawback of such shutters is that they are unable to completely intercept the light beam for a lengthy period. This is due to the considerable heat which develops on the shutter surface, so deforming it and making the shutter unusable.

An object of the invention is to overcome said drawbacks within the framework of a rational and economical solution.

DISCLOSURE OF THE INVENTION

The invention attains this and further objects by providing an electronic system for controlling the power fed to short arc lamps able to generate and control light effects such as a dimmer effect and a stroboscopic effect.

The electronic control system of the invention is able to control the instantaneous power transmitted to the lamp and to vary it with such a frequency as to achieve a stroboscopic effect at the ideal frequency perceivable by the human eye, or to achieve a dimmer effect.

More specifically, said system comprises an electronic power unit of switching type controlled by a feedback system which causes it to deliver power on the basis of a reference value which can oscillate between zero and the maximum allowable lamp power. Said reference value can be set by the operator or be generated by a suitable pulse generator.

To better clarify the constructional and operational characteristics of the invention a preferred embodiment thereof is described hereinafter by way of non-limiting example and illustrated on the accompanying drawings.

Figure 1B:
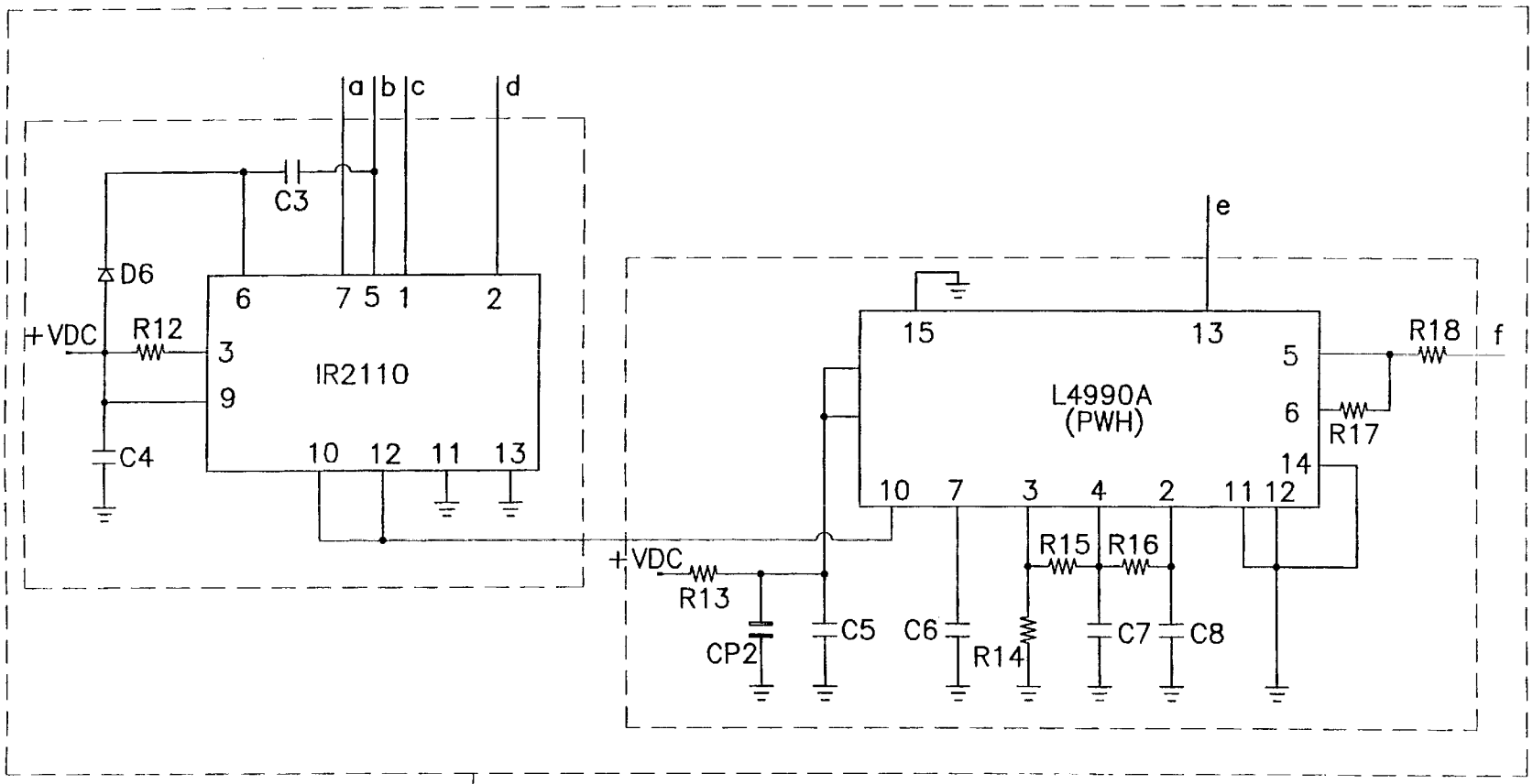
Figure 1C:
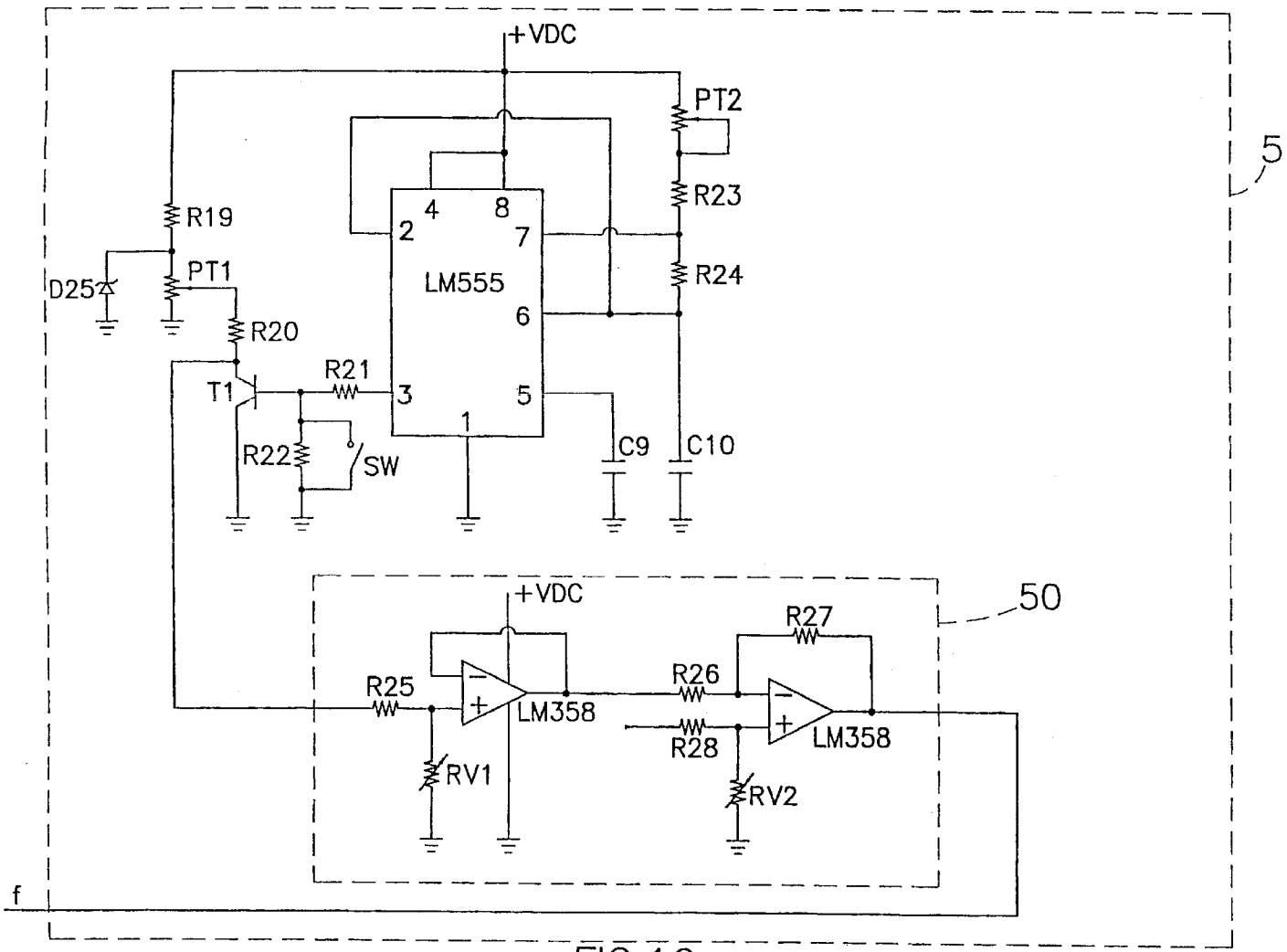

FIGS. 1A, 1B and 1C illustrate the electronic power and control circuit of the invention.

The figures show the lamp 1 (with relative firing device), which is fed by a power block 2. Said power block 2 is connected to the electrical mains supply by way of a usual rectifier 3.

Specifically, the power block 2 comprises a transformer TR1 the primary winding of which is pulse-fed by four identical MOSFET transistors TM1, TM2, TM3, TM4. The conduction or inhibition of the four transistors TM1, . . . , TM4 is controlled by the control block 4.

A normal measurement transformer TR2 is connected into the secondary circuit of the transformer TR1 to withdraw a small part of the instantaneous current circulating through the secondary winding of the transformer TR1 in order to obtain a voltage value therefrom and feed it to the control block 4. The control block 4 is therefore connected to the power block 2 in such a manner as to provide first order feedback follower control. The control block 4 comprises a PWM (pulse width modulator) electronic card, which in the illustrated example is of type L4990 manufactured by Thomson, its purpose being to compare the voltage value corresponding to the instantaneous current fed to the lamp 1 with a reference value generated by the pulse generator block 5. In detail, the generator block 5 is formed from an astable-connected timer LM555 generating voltage pulses at a frequency of between 3 and 19 Hz, which the user can vary by adjusting the trimmer PT2. The user can also vary the amplitude of the voltage generated by the timer LM555, which is done by adjusting the trimmer PT1. Between the output of the timer LM555 and the PWM card L4990 there is connected a signal adapter station 50, comprising two identical operational amplifiers LM358 connected as in FIG. 1C.

The PWM card L4990 compares the value of the instantaneous voltage signal withdrawn by the transformer TR2 with the voltage generated by the timer LM555. If the voltage generated by the timer LM555 exceeds the instantaneous voltage withdrawn by the transformer TR2 the PWM card L4990 increases the conduction time of the MOSFETS. If the opposite is the case, ie the instantaneous voltage fed to the lamp exceeds the reference voltage generated by the timer LM555, the PWM card L4990 decreases the conduction time of the transistors TM1, . . . , TM4.

The transistors TM1, . . . , TM4 are not controlled directly by the card L4990 but via an integrated circuit or driver IR2110. To achieve the stroboscopic effect, the operator adjusts the trimmer PT2 to set the pulse frequency generated by the timer LM555 to a value of between 8 and 12 Hz.

In contrast, to achieve the dimmer effect the operator closes the switch SW to short-circuit the resistor R22 in order to obtain a constant reference signal, and then adjusts the trimmer PT1 to decrease the amplitude of said reference signal.

The ensuing table summarizes all the technical characteristics of the constituent components of the invention shown in FIGS. 1A, 1B, 1C, and the relative connections.

| Component | Type | Value | Make |
|---|---|---|---|
| RD | Rectifier | | |
| R1, R3, R5, R7, R25, R26, R27 | Resistor | 22 KΩ | |
| R2, R4, R6, R8 | Resistor | 15 KΩ | |
| R9 | Resistor | 18 | |
| R10, R20, R22 | Resistor | 4K7 | |
| R11, R15 | Resistor | 100 KΩ | |
| R12 | Resistor | 2R2 | |
| R13 | Resistor | 5R6 | |
| R14 | Resistor | 70 KΩ | |
| R16 | Resistor | 5K6 | |
| R17, R28 | Resistor | 47 KΩ | |
| R18, R24 | Resistor | 33 KΩ | |
| R19 | Resistor | 100 Ω | |
| R21, R23 | Resistor | 10 KΩ | |
| RV1 | Variable Res. | 10 KΩ | |
| RV2 | Variable Res. | 5K6 | |
| PT1 | Trimmer | 1 KΩ | |
| PT2 | Trimmer | 470 KΩ | |
| TM1, TM2, TM3, TM4 | MOSFET Transistor | STW 2ONB50 | Sgs-Thomson |
| T1 | Transistor | BC237B | |
| DZ1, DZ2, DZ3, DZ4 | Zener Diode | 18 V | |
| DZ5 | Zener Diode | 10 V 1 W | |
| D1, D2 | Diode MUR 860 | | |
| D3, D4 | Diode RURG 8060 | | |
| D5 | Diode BAT 49 | | |
| D6 | Diode MUR 160 | | |
| S | Discharger | V130 LA10 | |
| TR1 | Transformer | | |
| TR2 | Transformer | | |
| L | Inductance | | |
| C1 | Capacitor | 470 nF | |
| C2 | Capacitor | 100 pF | |
| C3, C6, C7 | Capacitor | 100 nF, 50 V | |
| C4, C5, C10 | Capacitor | 1 μF, 50 V | |
| C8 | Capacitor | 3n3 | |
| C9 | Capacitor | 10 nF | |
| CP1 | Capacitor | 470 μF, 200 V | |
| CP2 | Capacitor | 100 μF, 25 V | |
| IR2110 | Driver | | International Rectifier |
| L4990A | PWM Electr. Card | | Sgs-Thomson |
| LM555 | Timer | | National |
| LM358 | Operational Amplif. | | |
| SW | Switch | | |

It should be noted that the control system of the invention can also be used on readily available known power units. The invention can further be applied to projectors using alternating current arc lamps of metal halide type or the like. For this purpose it is sufficient to connect a DC/AC converter between the power unit output and the lamp to convert the current from direct to alternating.

What is claimed is:

1. An electronic system for generating and controlling light effects on a projector utilizing at least one arc lamp, comprising an electronic power unit provided with a transformer fed via transistors, a secondary circuit of said transformer being connected to feed terminals of said lamp, wherein within the secondary circuit of said transformer there is connected a means for withdrawing a proportion of the instantaneous current circulating through said secondary circuit to produce an electrical signal which is made available to a control block which also receives an electrical reference signal generated by a generator block, said control block being arranged to compare said two electrical signals and to set said transistors to a conducting or inhibiting state depending on the result of said comparison, in which the amplitude and frequency of said electrical reference signal are adjustable by trimmer means controlled by an operator to obtain light effects perceptible by human eyes.

2. An electronic system as claimed in claim 1 characterized in that said control block comprises a PWM electronic card arranged to control the transistors by means of a driver circuit.

3. An electronic system as claimed in claim 1, characterized in that said generator block comprises a pulse generator.

4. An electronic system as claimed in claim 3, characterized in that said pulse generator is an oscillator.

5. An electronic system as claimed in claim 3, characterized in that said pulse generator is a timer.

6. An electronic system as claimed in claim 1, characterized in that the frequency of said electrical reference signal can be adjusted between 7 and 10 Hz to obtain a stroboscopic effect.

7. An electronic system as claimed in claim 1, characterized in that the amplitude of said voltage reference signal can be adjusted to obtain a dimmer effect after rendering constant the generator block output signal.

8. An electronic system as claimed in claim 1, characterized in that a DC/AC converter is connected between the output terminals of said electronic power unit and the feed terminals of the lamp to convert the direct current at the power unit output to alternating current.

* * * * *